United States Patent [19]

Osada et al.

[11] 4,095,764

[45] Jun. 20, 1978

[54] SPOT CONTROL TYPE AUTOMATIC TRAIN STOP SYSTEM UTILIZING GROUND CONTROL UNITS COMMON TO MORE THAN ONE BLOCK SIGNAL

[75] Inventors: Nobuhisa Osada; Hideo Nakamura, both of Tokyo, Japan

[73] Assignee: Japanese National Railways, Tokyo, Japan

[21] Appl. No.: 740,721

[22] Filed: Nov. 10, 1976

[30] Foreign Application Priority Data

Nov. 26, 1975 Japan ..... 50-140847

[51] Int. Cl.[2] ..... B61L 3/10

[52] U.S. Cl. ..... 246/182 B; 104/149; 364/436

[58] Field of Search ..... 104/149, 153; 235/150.2, 150.24; 246/62, 63 R, 63 C, 165, 167 K, 182 R, 182 B, 187 R, 187 A, 187 B, 187 C; 364/426

[56] References Cited

FOREIGN PATENT DOCUMENTS

| | | | |
|---|---|---|---|
| 1,371,823 | 8/1964 | France | 246/182 R |
| 2,433,666 | 1/1976 | Germany | 246/182 B |
| 978,559 | 12/1964 | United Kingdom | 246/182 B |

OTHER PUBLICATIONS

Yamaya, T., et al, Automatic Train Control Equipment, Toshiba Rev. (Int. Ed.) Japan, No. 52, Dec. 1970.

*Primary Examiner*—Stephen G. Kunin

[57] ABSTRACT

A spot control type automatic train stop system utilizing ground control units common to more than one block section signal. For at least one particular block section signal, one or more of the ground units positioned in a block section which precedes the particular block section signal by at least one block section is in a position in the preceding block section common to the position of the basic pattern generating ground unit for the particular block section signal. The signal transmitting system for the basic pattern generating ground unit of the particular block section signal transmits to the commonly positioned ground unit a first spot information signal when the particular block section signal is in the stop aspect and the commonly positioned ground unit is not receiving a spot information signal from a block section signal preceding the particular block section signal, so that the commonly positioned ground unit is a common ground unit for the block section in which it is located as well as for the particular block section signal. The train unit is such that it generates a basic distance-speed train braking pattern which is then cancelled and a short pattern generated which corresponds to the balance of the basic pattern at the time of cancellation thereof upon receipt of successive spot information signals from further ground units intermediate the basic pattern generating ground unit and the particular block section signal.

8 Claims, 14 Drawing Figures

SPOT CONTROL TYPE AUTOMATIC TRAIN STOP SYSTEM UTILIZING GROUND CONTROL UNITS COMMON TO MORE THAN ONE BLOCK SIGNAL

The present invention relates to a spot control type automatic train stopping system.

BACKGROUND OF THE INVENTION

As a safety device to avoid serious railway accidents, such as train collisions due to the failure of a train crew on a running railway train to recognize a signal, there has heretofore been known an automatic train stopping control system (ATS), whereby an alarm is issued to a train about to enter a danger zone, and when the speed of a train which has entered the danger zone exceeds a distance-speed pattern for the specific train, braking is automatically carried out to bring the train to a halt at a specific spot.

As described later with reference to FIGS. 1(*a*) and 1(*b*), such an automatic train stop control device consists of ground units and a train unit. The ground units are distributed along the track and successively react to the aspects of a signal which changes with the progress of the train, sending the signal aspects to the train unit carried by the train. The train unit in response to the information transmitted from the ground units generates a distance-speed train pattern specific to the train and causes the brakes of the train to be applied if the train speed exceeds the speed of the distance-speed train pattern.

Depending on the mode of control, the conventional automatic train stopping systems may be roughly classified into two types: a spot control type in which control information is transmitted in response to signal aspects of a block section signal to a train at specific spots only, and a continuous control type in which the control information is continuously transmitted to a train through a track circuit or the like. The two types possess various advantageous features and it is difficult to decide which is better. However, the spot control type, which has a relatively simple system configuration including the ground equipment, is superior to the continuous control type in terms of ease of equipment maintainance and cost.

Among various types of systems into which the spot control type of systems may be subdivided, the most desirable is the train pattern type system which permits setting a distance speed train braking pattern in accordance with the braking performance of the train.

The train pattern type systems can be still further divided into a two-stage pattern type system in which a distance-speed braking pattern specific to the train and which corresponds to the stop aspect (R) and caution aspect (Y) of a block section signal can be generated on the train at a specific pattern-generating spot ahead of, with respect to the direction of movement of the train, the signal, and which is determined by the longest braking distance for the train, and a single-stage pattern type system in which only a pattern corresponding to the stop aspect (R) of the block section signal can be generated on the train.

On a railway line where the signal block section is long enough and the pattern-generating spots are located within a block section next preceding the relevant block section signal, there is fundamentally no difference between the single-stage pattern type system and the two-stage pattern type system, because in either case there is no possibility of the patterns overlapping in the same block section. But on a line where short block sections succeed one another and the pattern-generating spots occur ahead of a block section signal located ahead of the relevant block section signal there is a possibility of the pattern overlapping. From the standpoint of the logic of generating train control systems, a single-stage pattern type system would be preferable if said pattern were to be applied as a common ATS to diverse trains with different braking performances. Even with a single-stage pattern type system, insofar as the pattern overlap is concerned, where the quantity of information required will amount to the number of signals times the number of information spots and numerous patterns will need to be memorized, executed patterns cancelled, and patterns selected for execution, the pattern-generation logic becomes complicated and in consequence the advantages of the spot control, i.e. simplicity and economy, will be lost.

SUMMARY OF THE INVENTION

In view of the foregoing situation, the first object of the present invention is to provide a spot control type automatic train stop system in which it is unnecessary to memorize numerous patterns and signals in the train pattern generator, and the spot information and the pattern cancelling signal from the ground unit simply cause generation of a pattern or cancellation thereof; and even in a pattern overlap section of a railway line, just as on a line composed of only block sections which are longer than the longest braking distance, a simple control logic based on a few pieces of information can be used.

The second object of the present invention is to provide a spot control type automatic train stop system in which at specific spots, depending on the length of the shortest block section and the quantity of information usable between the basic pattern generating spot and the block section boundary, more than one ground unit is installed, and in which, by producing, in response to a spot information signal from an intermediate ground unit, a short distance speed pattern for the relevant spot is produced which logically overlaps the basic pattern, the logic error of the pattern itself is corrected and the accuracy of the distance and speed of the basic pattern are improved, and in which, when, for instance, a more severe braking pattern is to be followed in an emergency such as a crossing ahead of a block section signal being obstructed, the spot information from the intermediate ground unit makes it possible to ensure emergency protection, and even in the event of the first ground unit failing to give proper information, a potential hazard can be well handled.

These objects are achieved by a spot control type automatic train stop system according to the invention for use in a train control system having block section signals at the junctions between successive block sections of a railway line, said automatic train stop system comprising: a train unit for mounting on a train and having means responsive to a first spot information signal for generating a basic distance-speed train braking pattern for the train according to which the train can be brought to a stop from the maximum speed, and having means responsive to each of further successive spot information signals for cancelling the basic pattern and generating a pattern which substantially corresponds to the remainder of said basic pattern subsequent to the time of cancellation thereof, and means responsive to a cancellation signal for cancelling all patterns; a control means on said train coupled to said train unit for comparing the actual speed of the train with the speed from the generating means and braking the train when the actual speed exceeds the pattern speed; a basic pattern generating ground unit corresponding to each block section signal and positioned at a point along said railway line preceding a block section signal to which the train is to respond at a distance ahead of the block section signal at least equal to the longest braking distance of the train; signal transmitting means coupled between each block section signal and the corresponding basic pattern generating ground unit for transmitting to said basic pattern generating ground unit a first spot information signal when the corresponding block section signal is in the stop aspect and for transmitting to said basic pattern generating ground unit a cancellation signal when the corresponding blocksection signal is in the caution or go aspect; at least two further ground units positioned at intervals between each basic pattern generating ground unit and the corresponding block section signal; further signal transmitting means coupled between each block section signal and the corresponding further ground units for transmitting to said further ground units further successive spot information signals corresponding to the respective positions of said further ground units when the corresponding block section signal is in the stop aspect and for transmitting to said further ground units a cancellation signal when the corresponding block section signal is in the caution or go aspect; and a cancellation signal ground unit positioned adjacent each block section signal for transmitting a cancellation signal to said train unit; and still further signal transmitting means coupled between each block section signal and the corresponding cancellation signal ground unit for transmitting to said cancellation signal ground unit a cancellation signal when the corresponding block section signal is in the caution or go aspect.

The basic pattern generating ground units can be positioned subsequent to the block section signal next preceding the corresponding block section signal, and all of the ground units for the corresponding block section signal will then be within the block section preceding said corresponding block section signal.

For at least one particular block section signal, at least one of the ground units positioned in a block section which precedes said particular block section signal by at least one block section is in a position in said preceding block section common to the position of the basic pattern generating ground unit for said particular block section signal and has the signal transmitting means for the basic pattern generating ground unit of said particular block section signal connected thereto for transmitting to said commonly positioned ground unit a first spot information signal when said particular block section signal is in the stop aspect and said commonly positioned ground unit is not receiving a spot information signal from a block section signal preceding said particular block section signal, whereby the commonly positioned ground unit is a common ground unit for the block section in which it is located as well as for the particular block section signal. The commonly positioned ground unit can be a further ground unit or a cancellation signal ground unit.

In addition, for said particular block section signal, at least one of the ground units positioned in a block section which precedes said particular block section signal by at least one block section is in a position in said preceding block section common to the position of one of the further ground units for said particular block section signal and has the signal transmititng means for the further ground unit of said particular block section signal connected thereto for transmitting to said commonly positioned ground unit a further spot information signal when said particular block section signal is in the stop aspect and said commonly positioned ground unit is not receiving a spot information signal from a block section signal preceding said particular block section signal, whereby said commonly positioned ground unit is a common ground unit for the block section signal in which it is located as well as for the particular block section signal.

BRIEF DESCRIPTION OF THE DRAWINGS

Other objects, features and advantages of the present invention will become apparent from the following detailed description taken in conjunction with the attached drawings, wherein:

FIG. 1(*b*) is a block diagram showing the relation between the train unit and the ground unit in FIG. 1(*a*);

FIGS. 3(*b*)–3(*d*) are, respectively, line diagrams illustrating variations of various factors concerning the movement of a train in relation to FIG. 3(*a*);

FIGS. 5(*b*)–(*d*) are line diagrams illustrating the variations of various factors with the movement of a train in relation to FIG. 5(*a*);

DETAILED DESCRIPTION OF THE INVENTION

To help in understanding the present invention, the conventional method of automatic train control will be briefly described with reference to FIGS. 1(*a*) and 1(*b*).

Figure 1A:
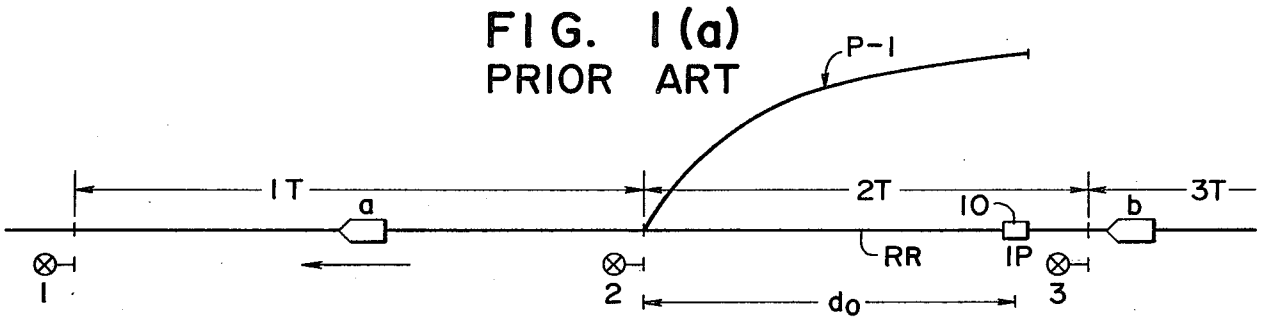
FIG. 1(a) PRIOR ART
FIG. 1(*a*) is a schematic line diagram showing the relation between the spot information and generation of a distance-speed train braking pattern in a conventional spot control type automatic train stop system.
Figure 1B:
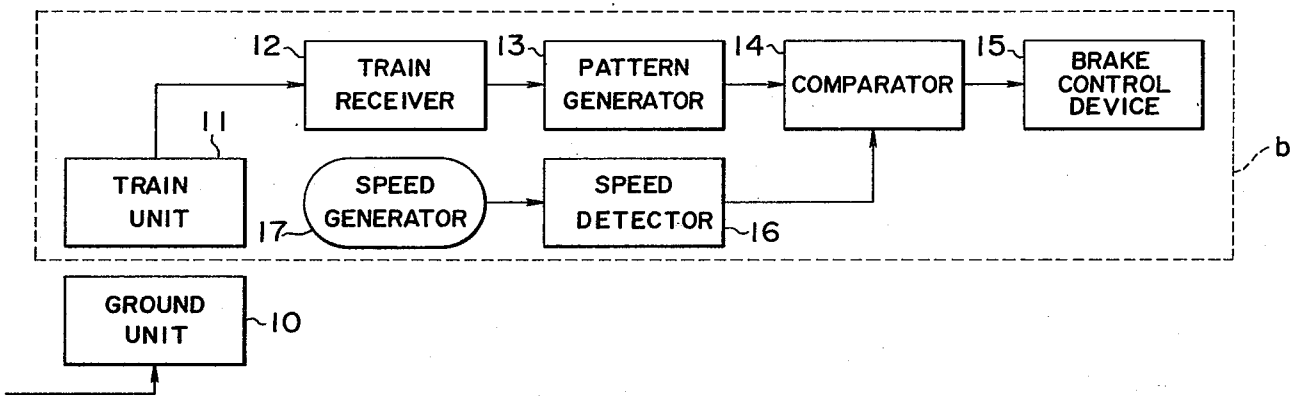
FIG. 1(b) PRIOR ART

In FIG. 1(*a*), RR is a railway track and 1T–3T are, respectively, block sections constituting a well-known track circuit. When a train *a* comes into the block section 1T, while moving in the direction of the arrow, the conventional signalling system causes the block section signal 2 at the beginning of block section 1T (or the end of the preceding block section) to give a stop indication R to the succeeding train *b* and the block section signal 3 at the beginning of the preceding block section 2T to give a caution indication Y. While the train *a* is present in the block section 1T, the train *b* must come to a halt just before the block section signal 2, which is in the stop aspect. Meanwhile, the engineer on the train *b* must watch the block section signal 2 well so that he can stop the train *b* just before it reaches the block section signal 2.

Lest the train *b* should invade the block section 1T due to the engineer's failure to recognize the block section signal, the signal aspect to which the block section signal 2 has changed is transmitted through a transmission line to a ground unit 10 located at a pattern-generating spot 1P in the block section 2T.

Since the ground unit 10 is located along the railway R such that it can exchange information through magnetic induction with a train unit 11 mounted on the train *b*, as shown in FIG. 1(*b*) block section signal aspect is displayed on the train receiver 12 through the train unit 11 on the train *b* which has invaded the block section 2T. Thereupon, in a conventional pattern generator 13 a distance-speed train braking pattern P-1 specific to said train is generated and supplied to a comparator 14. On the other hand, based on the information from a conventional speed signal generator 17 installed on the train *b*, a conventional speed detector 16 detects the actual speed of the train *b* and the information on this actual speed is supplied to a comparator 14. In the comparator 14, a comparison is made between the speed of the distance speed train braking pattern from the pattern generator 13 and the actual speed information from the speed detector 16. The speed control information gained thereby is supplied to a brake control device 15 to cause the train *b* to be automatically stopped just before the block section signal 2.

The distance between said pattern generating spot 1P and the block section signal 2 is made equal to the longest braking distance, i.e. the distance $d_o$ necessary to bring the train *b* to a halt from the maximum speed, so that said train *b*, even if traveling at maximum speed, can be safely halted just short of the block section signal 2.

When the train *a* moves out of the block section 1T, the block section signal 1 at the end of block 1T (which corresponds to the beginning of the next block section), changes from the go-ahead aspect G to the stop aspect R, while the block section signal 2 changes from the stop aspect R to the caution aspect Y; and when the train *b*, moving toward the block section signal 1 from ahead of the signal 1 reaches a spot at a distance equivalent to the longest braking distance from the block section signal 1, just as in the above description for block section 2T, the aspect of block section signal 1 is transmitted to the train *b* to produce the distance speed train braking pattern, whereby in the event of the train speed exceeding the speed of the distance-speed train braking pattern, the control device acts so that said train will be braked and stopped just before the block section signal 1.

The control system just described is an example of the so-called single-stage pattern type system in which the spot information, i.e. the information transmitted to the train unit at the pattern-generating spot, corresponding to the indication of the next succeeding block section signal, if that signal is in a stop aspect, causes a pattern to be generated, and when the actual train speed exceeds the speed of said pattern, braking is carried out to bring the train to a halt at a specified spot.

In addition, there is also widely employed a two-stage pattern type system in which a pattern specific to a given train is generated corresponding to the caution aspect Y and spot aspect R indicated by the next two succeeding block section signals, thereby preventing a signal violation. According to this system, in response to the indication of the caution aspect Y by the first one of the next two succeeding block section signals and the indication of the stop aspect R by the second one of the next two succeeding block section signals, the spot information is given to the train at a specific spot preceding the signals, thereby controlling movement of the train in two stages, i.e. controlling the train speed to, say, 50 Km/h, just ahead of the first block section signal, and bringing the train to a halt just before the second block section signal.

The single-stage pattern type system and the two-stage pattern type system of the prior art will be compared with each other in terms of the distance vs. pattern generation.

Figure 2:
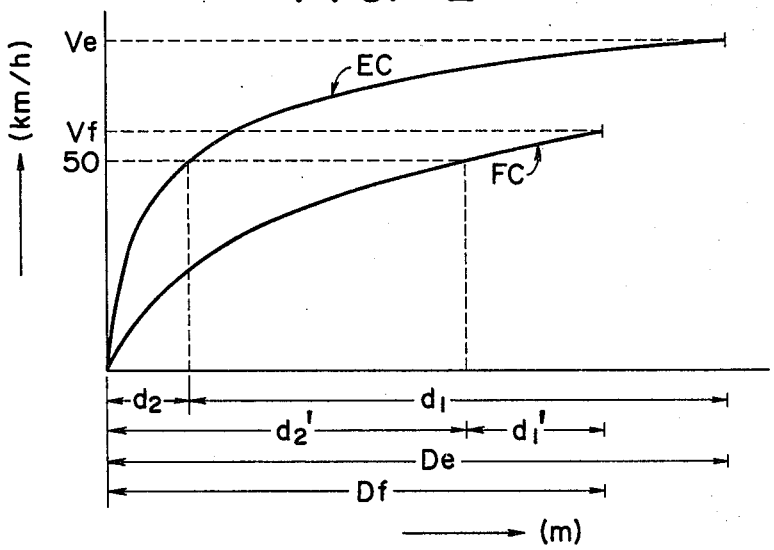
FIG. 2 is a graph comparing the distance-speed train braking patterns of two trains with different maximum speeds and different average decelerations.
Figure 3A:
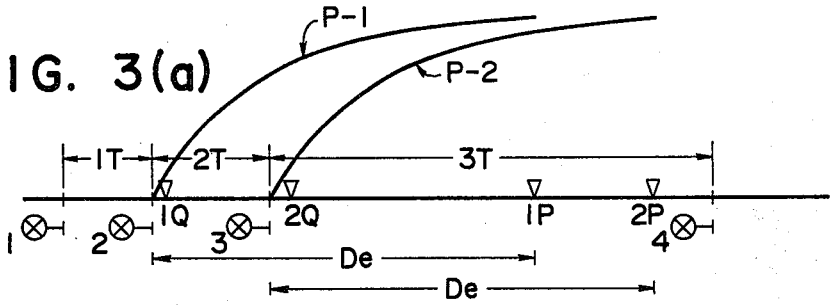
FIG. 3(*a*) is a line diagram showing the relation between the spot information and the distance-speed train braking pattern where a single-stage pattern system of a conventional spot control type automatic train stop system was used on a high density railway line.
Figure 3B:
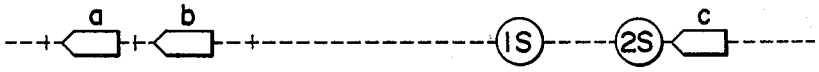
Figure 3C:
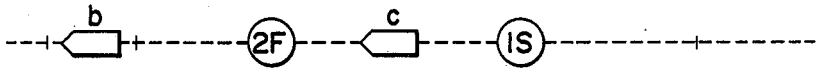
Figure 3D:
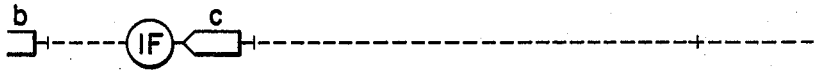

FIG. 2 illustrates the distance-speed train braking pattern curves, respectively, for a train EC, which has both a high maximum speed and a fast average deceleration, and a train FC which has both a lower maximum speed and a slower average decleration than train EC, the ordinate being the train speed and the abscissa being distance. In the two-stage pattern, it is supposed that the train speed is to be decelerated to 50 Km/h, as indicated by the horizontal dotted line, at the position of a block section signal indicating a caution aspect Y.

If in FIG. 2 the distances for trains EC and FC to come to a halt from the maximum speed, i.e. the longest braking distance, are, respectively, D*e* and D*f*, and the distances for the respective trains to slow down from their maximum speeds V*e* and V*f* to 50 km/h, i.e. the braking distances to the intermediate speed, are $d_1$ and $d'_1$, and the distances for them to come to a halt from 50 Km/h are $d_2$ and $d'_2$, the criterion for establishing the common pattern generation spot for the two trains will be D*e*, i.e. the longest braking distance, in the case of the single-stage pattern type system, and $d_1$ in the case of the two-stage system. In the case of the two-stage pattern type system, however, $d_1$ and D*e* are close to each other, because with an increase in the maximum speed and the average deceleration, $d_2$ for train EC becomes relatively short as compared with $d_1$.

Thus, as viewed in terms of distance vs. pattern generation, it is not always true that the single-stage pattern type system is by far more advantageous than a two-stage one.

In the train pattern type system of the spot control type, traditionally the two-stage pattern has been preferred, but on a conventional common railway line where the trains have generally the same braking performance and the block sections are sufficiently long so that the pattern-generating spots for control in response to the signals at the end of the block sections are invariably located within the corresponding block sections (or where the signal is considered to be at the beginning of a block section, the pattern generating spot is in the next preceding block section), adoption of the single-stage pattern type system or the two-stage pattern type system makes no difference in the sense that there is no possibility of the patterns overlapping. However, when a train pattern type system is adopted as a common ATS for diverse trains with different braking performances on a high density railway line where short block sections succeed one another and the pattern-generation spot is located within a block section which precedes the relevant block section signal by several block sections so that, depending on the train position, there is a likelihood of train patterns overlapping, as described later, the memory function for the distance speed train braking pattern in the two-stage pattern system will have to be double that for the single-stage system, and thus the single-stage system will become more advantageous in terms of train control logic.

In FIGS. 3*a*–3*d* is illustrated the relation between the spot information and the distance-speed train braking pattern generation for two pattern overlap where the known single-stage pattern system of the spot control type is applied to a high density line. With respect to the longest braking distance, the pattern-generation spots 1P and 2P for the block section signals 2 and 3 at the start of block sections 1T and 2T, respectively, are set at a distance D*e* ahead of the block section signals 2 and 3; and the pattern-cancel spots 1Q and 2Q corresponding to said pattern-generation spots 1P and 2P are set along the rails adjacent the block section signals 2 and 3. Meanwhile the distance-speed train braking patterns generated on the train in response to the spot information signals 1S and 2S transmitted to the train through magnetic induction at pattern-generation spots 1P and 2P, as described with reference to FIGS. 1(*a*) and 1(*b*), when the block section signals 2 and 3 are in the stop aspect are, respectively, P-1 and P-2. These two patterns have the same profile, but they are logically separated from each other in the conventional system for the purpose of correlating the spot information and the distance-speed train braking pattern in the interest of increased failsafe operation and reliability in the pattern generation logic configuration. The same can be said for the cancel signals 1F and 2F transmitted to cancel the patterns P-1 and P-2 from the pattern-cancel spots 1Q and 2Q to the train.

When, as shown in FIG. 3(*b*), a train *c* invades the block section 3T and passes the pattern-generation spot 2P while trains *a* and *b* occupy the block sections 1T and 2T, the spot information signals 2S, which indicates that signal 3 is in the stop aspect R, causes the train pattern P-2 to be generated on the train *c*. If the train *c* progresses farther and passes the spot 1P, the spot information signal 1S, which indicates that signal 2 is in the stop aspect R, causes the pattern P-1 to be generated on the train *c*. However, the train *c* continues to be braked in accordance with the pattern P-2, while the pattern P-1 is merely memorized on the train.

When, as illustrated in FIG. 3(*c*), the train *b* moves out of the block section 2T into section 1T, the block section signal 2 indicates "stop" while the block section signal 3 indicates "caution", whereupon, in response to the "caution" indication of the block section signal 3, the pattern-cancel spot 2Q installed along the rail adjacent to the block section signal 3 issues the cancel signal 2F. As the train *c* passes the pattern cancel spot 2Q, said train receives the cancel signal 2F from said pattern-cancel spot 2Q, whereupon the pattern P-2 on the train is cancelled. Thereafter, the train is braked in accordance with the pattern P-1.

Similarly, as illustrated in FIG. 3(*d*), when the train *b* moves out of the block section 1T, the block section signal 1 indicates "stop", while the block section signal 2 indicates "caution". Then the pattern-cancel spot 1Q installed adjacent the block section signal 2 issues the cancel signal 1F and in consequence the train *c*, as it passes said pattern-cancel spot 1Q, receives said cancel signal 1F, whereupon the pattern P-1 is cancelled, and the train is controlled according to conditions of the signals in block sections subsequent to block section 1T.

As described above, on a line where two patterns overlap, if the conventional system is used, the quantity of pieces of information being handled is four, i.e. signals 1S, 2S, 1F and 2F, while the number of patterns memorized is two, i.e. P-1 and P-2.

Thus, on a line with pattern overlapping, if the conventional spot control is employed, the quantity of information required to achieve reliability of the pattern generation mechanism is basically the number of pattern stages times the number of signal information spots times the number of overlaps; the number of patterns to be memorized is the numer of pattern stages times the number of overlaps; and the total number of information spots, i.e. pattern generation spots and pattern cancel spots, is the number of signal information spots times the number of signals. Moreover, when diverse trains with differences in the maximum speed and in the braking performance are moving over the railway line, as easily seen in the case of FIG. 2, the distance D*e* of the pattern-generation spots ahead of the relevant block section signals will tend to increase; and in order to prevent a decrease in the ability of the train to follow the pattern in response to changes of the block section signal, an intermediate pattern cancel spot will have to be provided in addition to the ground unit for the pattern-cancel spot adjacent to the block section signal. Thus, if the number of information spots for each block section signal becomes three, i.e. the pattern-generation spot, the pattern-cancel and the intermediate pattern-cancel spot, the quantity of information required on a railway line where three patterns overlap would be nine for a single-stage pattern type system and 18 for a two-stage pattern type system.

At the present time, the quantity of information which the variable frequency receiver presently available for use as the train receiver in a spot control type system can handle with stability is limited to 6–7 pieces of information, and therefore when the number of intermediate spots needed for pattern generation or pattern cancel functions or the number of overlaps increases, even the adoption of a single-stage pattern system, which is advantageous when there are only a few pieces of information being handled, will not result in limiting the quantity of information sufficiently to permit use of a single receiver. Moreover, the pattern memory on the train would have to be able to handle as many patterns as there are overlaps, thereby complicating the logic mechanism for pattern generation and leading to the loss of simplicity and economy characterizing the spot control type of system.

The present invention seeks to provide a solution to the above-described problems which are inherent in the conventional spot control system when it is applied to a high-density line.

The present invention will be described with reference to the embodiments illustrated in FIGS. 4–6.

Figure 4:
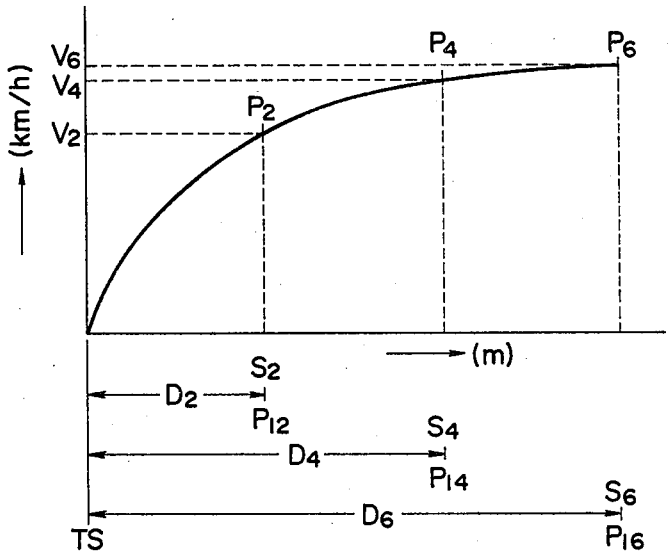
FIG. 4 is a graph illustrating an example of the basic distance-speed train braking pattern to be employed in the present invention.

FIG. 4 shows the basic distance-speed train braking pattern to be used in the system according to the present invention. In FIG. 4 the ordinate is the train speed and the abscissa is the distance from the train stop point TS. The basic pattern generator generates a pattern like generator 13 in FIG. 1*b* in response to the spot information signal $S_6$ from the pattern-generation spot $P_{16}$ which is located at the longest braking distance $D_6$ from train stop-point TS in the pattern $P_6$. Meanwhile, as described later with reference to the minimum block section length of a given line and the available quantity of information, pattern information spots $P_{14}$ and $P_{12}$ are positioned at distances $D_4$ and $D_2$ from the train stop point TS between the pattern generation spot $P_{16}$ for the basic pattern $P_6$ and the train stop point TS with the relationship among the distances being $D_6 > D_4 > D_2$. When the train receives a spot-information signal $S_4$ at the spot $P_{14}$, pattern $P_6$ is cancelled and execution of braking according to the short pattern $P_4$ is ordered, and when the train receives a spot-information signal $S_2$ at the spot $P_{12}$, pattern $P_4$ is cancelled and execution of braking according to the short-pattern $P_2$ is ordered. In other words, the spot information signals $S_6$, $S_4$ and $S_2$ are signals telling the train that the distances necessary for safe stopping are, respectively, $D_6$, $D_4$ and $D_2$. In accordance therewith, two separate short patterns $P_4$ and $P_2$, which appear to logically overlap the basic pattern $P_6$ are generated, and when the train speed exceeds the pattern speed, the train is braked to stop at TS according to the pattern. The spots $P_{14}$ and $P_{12}$ are intermediate to the spot $P_{16}$ where the basic pattern $P_6$ is generated. If they are to be, say, $D_2 = \frac{1}{3} D_6$ and $D_4 = \frac{2}{3} D_6$ so that the shifting of the pattern in the overlapping section can be carried out smoothly, when $D_6$ is 600m, $D_4$ will be 400m and $D_2$ will be 200m. Thus, the spot information signals transmitted to the train at these spots will mean that the safe distances within which to stop are, respectively, 600m, 400m and 200m. If in this case the train does not receive the spot information signals $S_4$ and $S_2$ after signal $S_6$ has caused generation of the basic pattern $P_6$, the basic pattern $P_6$ will continue to control the braking up to the train stop point TS as if following the short patterns $P_4$ and $P_2$. If the spot information signal $S_6$ causes generation of the basic pattern $P_6$ and thereafter the train receives the spot-information signal $S_4$, the basic pattern $P_6$ will be cancelled and short pattern $S_4$ will be generated. Later, if the train does not receive the spot-information signal $S_2$, the short pattern $S_4$ will continue to control braking up to the train stop point TS, as if following the short-pattern $P_2$. In the case of spot information signals $S_6$, $S_4$ and $S_2$ being successively received on the train, the basic pattern $P_6$ is generated in response to signal $S_6$ and then is cancelled in response to signal $S_4$, while at the same time the short pattern $P_4$ is generated; and in response to receipt of signal $S_2$ the short pattern $P_4$ is cancelled while at the same time the short pattern $P_2$ is generated.

In FIG. 4 which illustrates an example of the basic pattern according to the present invention, if there is a difference in the braking performance depending on the train, both the maximum speed $V_6$ and the pattern profile can be changed, and the number of spot-information signals can be set arbitrarily, depending on the minimum length of the block section of a given line and the quantity of information which can be handled.

In the above-described form of the distance-speed train braking pattern, by arranging the positions of the ground units for transmitting the spot information signals at the specified spots depending on the minimum length of the block section of a given line and the quantity of information and by supplying the signal aspect of the relevant signals to said positions via transmission lines, a train pattern system based on the use of only a few kinds of information signals and cancellation signals can be achieved.

Figures 5A, 5B, 5C, 5D:
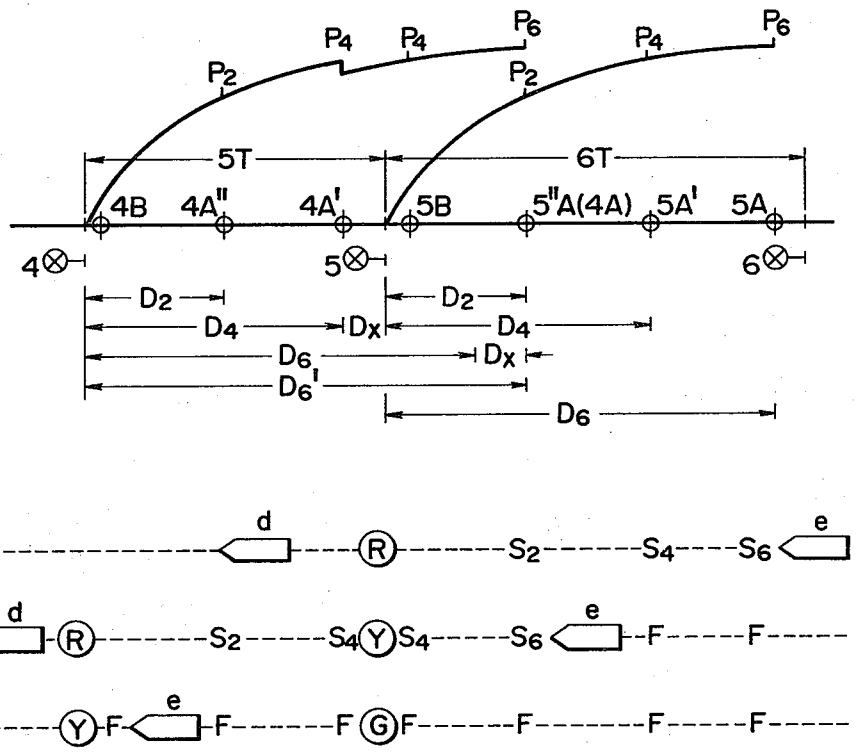
FIG. 5(*a*) is a line diagram showing the relation between the spot informaiton and generation of a distance speed train braking pattern in a two-train pattern overlap section.

FIG. 5(*a*) illustrates an embodiment of the present invention using the basic pattern of FIG. 4 on a line with two patterns overlapping, wherein the relation between the spot information and the pattern generation depending on the train position is shown.

In FIG. 5(*a*) where the block section 5T is shorter than the longest braking distance $D_6$ in FIG. 4, the pattern generating spot 4A at which the pattern $P_6$ is generated in response to a particular aspect of the block section signal 4 is located ahead of the block section signal 5 which next precedes block section signal 4, and between the block section signal 5 and the pattern generating spot 4A the patterns overlap. For the convenience of this explanation, it is assumed that the block section succeeding the block section signal 4 is longer than $D_6$, and there is no overlapping of patterns for the block section signal 4 and the block section signal next succeeding the block section signal 4.

The first ground unit 5A for the block section signal 5 is positioned at a distance $D_6$ ahead of the block section signal 5 and within the next preceding block section 6T; the second ground unit 5A′ is set at a distance $D_4$ ahead of the block section signal 5; the third ground unit 5A″ is set at a distance $D_2$ ahead of the block section signal 5; and the fourth ground unit 5B is set at, say, 20m ahead of the block section signal 5. The second ground unit 4A′ for the block section signal 4 is set at a distance $D_4$ ahead of the block section signal 4 within block section 5T; the third ground unit 4A″ is set at a distance $D_2$ ahead of the block section signal 4; and the fourth ground unit 4B is set at a spot adjacent the block section signal 4. A spot information signal, the nature of which depends on the aspect of the relevant block section signal, is transmitted by the ground unit at each spot to the train.

In the ensuing description, each block section signal is assumed to indicate the conventional three aspects, i.e. "stop" (R), "caution" (Y) and "go ahead" (G); and the various pieces of equipment for transmitting the information concerning these aspects to the relevant ground unit via a transmission line, transmitting the spot information from said ground unit to the train, and generating a specified distance speed train braking pattern when the spot information signal has the appropriate form and braking the train when the train speed exceeds the pattern speed are conventional pieces of equipment such as are used in conventional spot control.

Briefly referring to FIG. 1(*b*), each ground unit 10 is appropriately mounted along the track; each ground unit 10 is connected via a transmission line to the relevant signal; and, depending on the signal indication, either a spot information signal or a cancellation signal is received in the known manner. The train unit 11 is mounted on the train such that while the train is running, signal exchange can take place magnetic-inductively between the train unit 11 and said ground unit 10. As the train passes over the ground unit 10, the receiver 12 receives through the train unit 11 the signal being issued from said ground unit 10 and, where the signal is a spot information signal, the distance-speed train braking pattern generator 13 is actuated. The generator 13 is different from the conventional generator in that it generates a basic pattern based on the specific braking performance of the train and successive short patterns based on said basic pattern while cancelling the basic pattern or a preceding short pattern. Meanwhile the train is equipped with a conventional speed generator 17, from which the real speed of the train is detected by a speed detector 16, and this is sent to a conventional comparator 14 where the pattern speed from the distance speed train braking pattern generator 13 is compared with the real speed of the train in the known manner. When the real speed is excessive, the brake application is ordered through a conventional braking system 15 to bring the train to a halt at a train stop point according to the pattern.

Now, turning again to FIG. 5(*a*), the relation between the aspect indicated by the block section signal and each ground unit will be described.

When the block section signal 5 is in the R aspect, in response to this signal aspect, the spot information signal $S_6$ in FIG. 4 is supplied to the ground unit 5A; the spot information signal $S_4$ is supplied to ground unit 5A'; and the spot information signal $S_2$ is supplied to ground unit 5A''. When the block section signal 5 is in the Y aspect, the cancellation signal F is supplied to ground units 5A and 5A', the spot information signal $S_6$ is supplied to ground unit 5A'', and the spot information signal $S_4$ is given to ground unit 5B. When block section signal 5 is in the G aspect, all ground units are supplied with a cancellation signal F. The signal F is a signal which causes cancellation of the pattern generated on the train by the pattern generator, and in the same manner as in the conventional control system of this kind, the distance-speed train braking pattern is cancelled.

When the block section signal 4 is in the R aspect, the ground unit 4A' is supplied the signal $S_4$, while the unit 4A'' is supplied the signal $S_2$. When block section signal 4 indicates Y and G aspects, there will be no overlapping of patterns when the block section subsequent to the signal 4 is longer than the maximum braking distance; and accordingly, all the signals given to the ground units will be cancellation signals F.

As described above, the intermediate spot distance in the block sections 5T and 6T is set, say to be 4B–4A'' = 4A''–4A' = 5B–5A'' = 5A''–5A' = 5A'–5A. Then, normally the distance D*x* between 4A' and the block boundary corresponding to the block section signal 5 will be shorter than the intermediate spot distance.

With this arrangement the generating spot for the basic pattern $P_6$ for the block section signal 4 is shifted from its conventional position ahead of the block section signal 5 to the spot 5A'' separated by distance $D_2$, i.e. the intermediate spot distance, from the block section signal 5; and this spot 5A'' is used as a common information spot for both the block section signals 4 and 5. Thus, the ground unit 5A'', when the block section signal 5 is in the R aspect, issues the spot information signal $S_2$ independently of the signal aspect of the block section signal 4, thereby generating a short pattern $P_2$ for the block section signal 5 on the train.

When the block section signal 5 is in the Y aspect and the block section signal 4 is in the R aspect, the intermediate ground unit 5A'' is supplied with the signal $S_6$ and transmits it to the signal generator on the train to cause generation of the basic pattern $P_6$ for the block section signal 4, and when the short pattern $P_4$ for the block section signal 5 has been generated on the train, it is cancelled, thus assuring that no patterns overlap between the intermediate units 5B and 5A''. However, the location of the generating spot for the basic pattern $P_6$ for the block section signal 4 is located at a distance $D_6'(D_6+Dx)$ ahead of the relevant block section signal 4, i.e. a distance D*x* farther away from block section signal 4 than distance $D_6$; nevertheless, from the standpoint of safety, this does not cause any functional problem in the ATS. Moreover, the effect of the extra distance D*x* can be corrected by properly locating the generation spot 4A' for the short pattern $P_4$, and accordingly distance $D_6'$ is logically equivalent to distance $D_6$. As for the effect of the increased distance $D_6$ on the operating efficiency, there is no particular loss in the ability to carry out braking and to control braking because location 5B becomes an intermediate spot in addition to 4A' and 4A'', resulting in an ultimate increase of the intermediate spots. Where the length of the block section 5T is less than distance D4 but greater than distance $D_2$, the location of the generating spot for the basic pattern $P_6$ for the signal 4 will be at location 5A'.

Now suppose as in FIG. 5(*b*) that the train *d* is present in the block section 5T, the block section signal 5 is in the R aspect, and under these conditions a train *e* enters the block section 6T, thereby receiving the spot information signal $S_6$ from the ground unit 5A. Then the basic pattern $P_6$ for the block section signal 5 is generated on the train *e* and, as the train *e* moves on and receives the spot information signal $S_4$ from the ground unit 5A', basic pattern $P_6$ is cancelled and the short pattern $P_4$ appears on the train, although the pattern is as if pattern $P_6$ had continued. Further, when the train *e* reaches location 5A'' with the block section signal 5 still in the R aspect, the spot information signal $S_2$ causes pattern $P_4$ to be cancelled and short pattern $P_2$ to be generated on the train. When the train *e* comes to location 5B, the train *d* leaves the block section 5T and the block section signal 5 changes to the Y aspect, the train *e* receives the spot information signal $S_4$ at 5B and thereby the short pattern $P_2$ for the block section signal 5 shifts to the short pattern $P_4$ for the block section signal 4, whereupon the train passes block section signal 5 and enters block section 5T.

Where the train *e* comes to location 5A'' and then, as shown in FIG. 5(*c*), the preceding train *d* leaves the block section 5T, the block section signal 5 changes from the R to the Y aspect, whereupon the train *e* receives the spot information signal $S_6$ from the ground unit at 5A'' and the short pattern $P_4$ for the block section signal 5 is cancelled and the basic pattern $P_6$ for the block section signal 4 is generated. Similarly with progress of the train *e* under these conditions, at locations 5B and 4A', the spot information signal $S_4$ causes the short pattern $P_4$ for the block section signal 4 to be generated and at 4A'' the spot information signal $S_2$ causes the short pattern $P_2$ for the block section signal 4 to be generated. In this case, it is as if location 4A' was the generating spot for the short pattern $P_4$ for the block section signal 4 and at the same time the generating spot 4A for the pattern $P_6$ for the block section signal 4, as viewed from the block section signal 4, at a spot a distance $D_6$ from the block section signal 4. Thus, the correcting function to make $D_6'$ shorter by D*x* is provided.

Next, when, as indicated in FIG. 5(*d*), the block section signal 4 changes to the Y aspect at the instant the train *e* comes to location 4B, the cancellation signal F is issued from the ground unit at 4B and passage of the train *e* over this spot causes the short pattern $P_2$ for the block section signal 4 on the train to be cancelled, whereupon the train moves past the block section signal 4.

If during this process the speed of the train *e* exceeds the speed according to any of the distance-speed train braking patterns $P_6$, $P_4$, $P_2$ the brake is applied to stop the train *e* short of the corresponding block section signal.

Thus, according to the above embodiment, the ground unit which is at an intermediate spot serves not only to cancel the patterns, but also to cause the spot to be a spot for more than one block section signal, such as location 5A'' and to correct the distance, such as location 4A''. Such an intermediate spot can function not simply to cause a shift in the train pattern to a pattern for a higher speed, but can also provide emergency protection to respond to an indication of a lower speed in an emergency.

In an existing railway signal system, when a crossing occurs at a location subsequent to a block section signal and the crossing is obstructed, said block section signal is set at the R aspect independently of the block section signal aspect for indicating a train position, thereby indicating the existance of an obstructed crossing.

Suppose, for instance, that in FIG. 5(*a*), after the train *e* receives a cancellation signal F at location 5A, the block section signal 5 suddenly changes to the R aspect as the result of an obstructed crossing within the block section 5T. Then the train receives the spot information signal $S_4$ at 5A' and as a consequence the short pattern $P_4$ for the block section signal 5 is generated on the train. Even if the engineer's handling of the brake handle is slow on account of the weather conditions or poor visibility, the train will automatically be stopped ahead of the block section signal 5 when the train speed at the instant pattern $P_4$ is generated less than $V_4$ in FIG. 2; and even when it is more than $V_4$, it may be possible, although it depends on the distance between the block section signal 5 and the crossing, to bring the train to a halt before the crossing.

Thus, the emergency protection due to the presence of the ground unit at the intermediate spot is logically possible.

Even if the train does not receive the spot information signal $S_6$ from the first ground unit when the block section signal ahead of it is in the R aspect and the basic pattern $P_6$ is not generated, the short pattern $P_4$ or $P_2$ from the second or third ground unit will fulfill the function of the ATS, depending on the train speed at the instant of pattern generation. Contrariwise, where the basic pattern $P_6$ is generated, if the spot information from the second or third ground units fails to be received, the basic pattern $P_6$ will be continued as it is for the control of braking. Mere non-cancellation of any pattern will not lead to a dangerous situation. Such provision of ground units at intermediate spots which issue the spot-information signals will also reduce the possibility of a failure in transmission of information which might cause a dangerous condition.

In the common control system of this kind in which the distance-speed train braking pattern is formulated by calculating the distance of the train run from a count of wheel revolutions, a logical error in the pattern itself due to an error in the wheel diameter appears as a variance in the actual train stop point from the calculated stop point, i.e. the end of the pattern, and thereby the accuracy is approximately proportional to the pattern length, and the longer the pattern, the larger will be the error at the train stop point. In the present invention the patterns $P_4$ and $P_2$ generated at the intermediate spots appear to be mere extensions of the basic pattern $P_6$, but the logical error in the basic pattern $P_6$ as a whole is corrected at the intermediate spots; and when the distance $D_2$ is $\frac{1}{3}$ of $D_6$, the final error is equal only to that in the pattern $P_2$. Thus, as compared with a system having no intermediate spots, the accuracy of the present system where there are two intermediate spots is three times higher.

The ground units at the intermediate spots other than the pattern sharing spot 5A''-4A and the distance correcting spots 4A'' and 5A'' may, beginning with the second ground unit, be positioned in accordance with the operating mode of a given railway line; and even if they were omitted, the fundamental performance of the ATS would not be harmed. When in FIG. 5, 4A' is omitted, 4A'' will become the distance correcting spot. If the purpose of the ground unit is simply cancellation of a pattern for the purpose of improving the control still more, a ground unit can be provided at an arbitrary spot between 5A and 4B in FIG. 5, other than from 5A'' to 5B, which issues a cancellation signal F when the block section signals 4 and 5 are in the Y or G aspects, or a pattern-cancelling ground unit for cancelling an already executed pattern may be provided when the block section signals are in the R aspect.

A pattern cancelling ground unit which is provided between 5B and 5A'' must be constituted such that it can issue a cancellation signal F in response to the block section signal 5 being in the G aspect.

According to the above embodiment, in the overlap section the ground unit for the generating spot 4A for the basic pattern $P_6$ for the signal 4 can also be the ground unit 5A'', whereby from the ground unit 5A'' the train will receive one of the signals $S_2$, $S_6$ or F merely depending upon the aspect indicated by the block section signal 5, thereby generating the desired pattern at the proper distance from the train stop position. Thus, the arrangement is invariably one block-one pattern, and, accordingly, there is no need, as described with reference to FIG. 3, for the train unit to memorize the pattern spot-information for the block section signal 4 in addition to that for the block section signal 5.

On the ground side of the system, the control conditions can also be simplified, because regardless of the aspect indicated by block section signal 4, locations 5A'' and 5B in the overlap section can be controlled by the aspects indicated by the block section signal 5.

The foregoing describes an example of a system in which the generating spot for the basic pattern for the block system signal 4 is at location 5A'' which is a distance $D_6'$ ahead of the relevant block system signal 4, where $D_6' = D_6 + Dx$. But when 5A'' is at a distance exactly $D_6$ ahead of block section signal 4, say for example if $D_6$ is 600m, the block section 5T is 580m long, the intermediate spot 5A'' will be 600m ahead of the block section signal 4, it goes without saying that there will be no trouble due to the difference $Dx$ between distances $D_6$ and $D_6'$.

According to the above embodiment, in the pattern overlap section where the information spot is common to two patterns, the number of ground units can be reduced and this reduction is greater the greater the number of overlaps and in the number of overlap sections.

As described above, in a two pattern overlap section such as shown in the parts of FIG. 3, the necessary number of items of information is the number of items of pattern information, i.e. four times the number of overlaps, i.e. two, which is eight. However, according to the present invention, as illustrated in FIG. 5, four items of information, corresponding to 5B, 5A'', 5A', 5A, will suffice for the two pattern overlap section. If the section is a three pattern overlap section, 12 items of information (number of items of pattern information × number of overlaps, i.e. 4 × 3 = 12) will be needed in the conventional system, but according to the present invention, as illustrated in FIG. 6, four items of information will suffice, just as in the two pattern overlap section.

Figure 6:
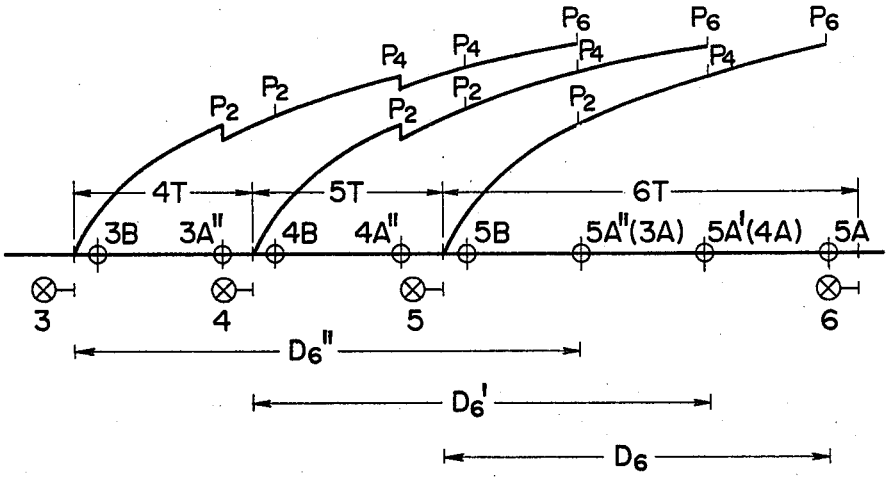
FIG. 6 is a line diagram showing the relation between the spot information and generation of a distance speed train braking pattern in a three-train pattern overlap section.

In FIG. 6 the reference characters which are the same as in FIG. 5 designate the same items as in FIG. 5. A block section signal 3 is located at the end of the block section 4T, and intermediate ground units are at spots 3B and 3A″ within the block section 4T. The distances 3B-3A″ and 4B-4A″ are, respectively, the same as the distances 5B-5A″, 5A″-5A′ and 5A′-5A, and $D_6''$ is equal to $D_6'$ plus the distance from 3A″ to the block section signal 4.

FIGS. 5 and 6 show examples of overlap sections where the effect of the present invention is prominent. The present invention, however, will provide a far more efficient control than the conventional system even in a non-overlap section.

Figure 7:
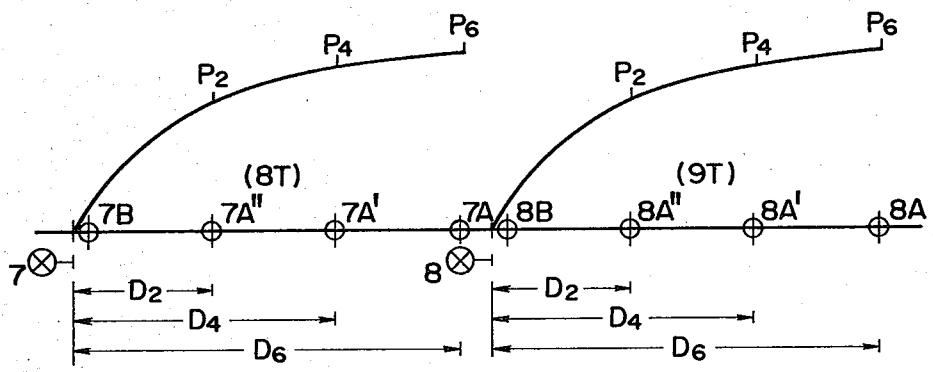
FIG. 7 is a line diagram illustrating the relation between the spot information and the pattern generation on a common line with no overlapping of distance-speed train braking patterns.

FIG. 7 illustrates an example of a common railway line with no overlapping of patterns, wherein the relation between the spot information and the pattern generation is shown.

In FIG. 7, the block sections 8T and 9T as well as a block section beyond the signal 7 are assumed to be longer than the longest braking distance $D_6$; and at distances $D_6$, $D_4$ and $D_2$, respectively, ahead of the block section signal 7 there are installed a first ground unit 7A, a second ground unit 7A′ and a third ground unit 7A″; at distances $D_6$, $D_4$ and $D_2$, respectively, ahead of the block section signal 8 there are installed a first ground unit 8A, a second ground unit 8A′ and a third ground unit 8A″; and ahead of the block section signals 7 and 8, at distances of, say, 20m, there are installed fourth ground units 7B and 8B. The arrangement can be, say, $D_6 = 3D_2$, $D_4 = 2D_2$ and $D_6 = 600$m and the signal aspects the conventional ones, that is, "stop" (R), "caution" (Y) and "go ahead" (G). When the block section signal 7 is in the R aspect, the ground units 7A, 7A′ and 7A″, in response to aspect R, will, respectively, issue the signals $S_6$, $S_4$ and $S_2$, respectively, and the unit 7B will produce no output. When the block section signal 7 is in the Y or R aspect, all of the ground units 7A, 7A′, 7A″ and 7B issue the signal F.

The same is true for the block section 8, and when it is in the R aspect, the ground units 8A, 8A′ and 8A″ issue the signals $S_6$, $S_4$ and $S_2$, respectively, and when it is in the Y or R aspects, all of the ground units 8A, 8A′, 8A″ and 8B issue the signal F.

Generation of the distance-speed train braking pattern in response to the spot information signals $S_6$–$S_2$ is the same as for the overlap section illustrated in the parts of FIG. 5. When the train receives the signal $S_6$, the basic pattern $P_6$ is generated; when it receives the signals $S_4$ or $S_2$, the apparent short patterns $P_4$ and $P_2$ are generated and the preceding pattern is cancelled; and when it receives the signal F, the pattern is cancelled.

On a common railway line, as illustrated in FIG. 7, the intermediate spots 7A′, 7A″, 8A′ and 8A″, which are not pattern sharing spots nor distance-correction spots, are not essential to an elemental system, but they are preferable for the purpose of achieving accuracy in following the basic pattern or for responding to the operating conditions of the line, such as the necessity for protecting against running through an obstructed crossing. As for the ground units for cancellation, they may be set at arbitrary spots between locations 8B and 8A or 7B and 7A so that the train pattern can be cancelled when the block section signals 7 or 8 are in the Y or G aspects, just as in the case of the overlap section of FIG. 5.

According to the present invention, which is one-step advanced over the conventional distance-speed train braking pattern with respect to the conception of distance, the distances to the block section signal which should not be passed when it is in the stop aspect are transmitted to the train as several kinds of spot information signals from a plurality of ground units installed at specific spots ahead of the block section signal, and the train unit acts in response to the specific kind of said signal, thereby simplifying the complicated control logic in dealing with diverse trains having different braking performances and which are operated on a high density railway line. With only a limited quantity of information, this system is nevertheless fully applicable not only to a common railway line containing a number of overlap sections, but to one without such sections.

The major effects of the present invention are as follows:

(1) Since the spot information signals and cancellation signals from the ground are always orders to cancel and generate all or part of a single pattern, there is no need for the pattern generator on the train to memorize numerous patterns and signals. Thus, in pattern overlap sections, as well as on a railway line without such sections, the control logic can be simplified by the use of only a few items of information.

(2) Any number of intermediate spots, other than pattern sharing spots and distance correcting spots, can be provided between the block section signal and the basic pattern generating spot, depending on the line conditions.

(3) The intermediate spots thus provided can correct any logical error in the pattern itself. Therefore, the accuracy of the distance and speed in the basic pattern can be improved, while at the same time the safety provided by the system can be improved because any dangerous situation calling for the emergency stopping or resulting from failure of the first ground unit to issue proper information can be appropriately dealt with.

(4) Provision of a ground unit for cancellation of the pattern at an arbitrary spot subsequent to the basic pattern generation spot, together with presence of the ground units at intermediate spots, can vastly improve the ability of the system to follow the basic pattern.

(5) According to the present invention, in a pattern overlap section, the basic pattern generating spot is usually located somewhat ahead of the longest braking distance, but because of the distance correction at the intermediate spots, the ultimate stopping pattern is the same as the common basic pattern. Thus, any adverse effect of the physical increase in the distance between the basic pattern generating spot and the train stopping spot on the pattern following ability can be prevented, because the number of intermediate spots in the pattern overlap section is increased as compared with a conventional system.

(6) In the pattern overlap sections where the ground units are common for two patterns, the number of ground units required is reduced as compared with the prior art systems, and the savings in the number of ground units increases with the number of overlaps or the number of sections, thereby improving the economy of the system.

(7) By the provision of several kinds of spot information signals, the present invention can be made applicable to yard operation with a low maximum speed.

(8) If the transmission point of the spot information signal to be transmitted from the ground to the train, i.e. the position of the ground unit, is at an arbitrary spot instead of being restricted to a specific spot, a continuous control type automatic train stop system using a distance-speed train braking pattern based only on the spot informations signals can be achieved.

What is claimed is:

1. A spot control type automatic train stop system for use in a train control system having block section signals at the junctions between successive block sections of a railway line, said automatic train stop system comprising: a train unit for mounting on a train and having means, other than a train braking pattern storage means for storing a plurality of train braking patterns, responsive to a first spot information signal for generating a basic distance-speed train braking pattern for the train according to which the train can be brought to a stop from maximum train speed, and having means, other than a train braking pattern storage means for storing a plurality of train braking patterns, responsive to each of further successive spot information signals for cancelling the entire basic pattern and regenerating the balance of said basic pattern subsequent to the time of cancellation thereof, and means responsive to a cancellation signal for cancelling the basic pattern and any regenerated balance of the basic pattern; control means on said train coupled to said train unit for comparing the actual speed of the train with the speed from the generating means and braking the train when the actual speed exceeds the pattern speed; a first signal transmitting ground unit corresponding to each block section signal and positioned at a point along said railway line preceding a block section signal to which the train is to respond at a distance ahead of the block section signal at least equal to the longest braking distance of the train; signal transmitting means coupled between each block section signal and the corresponding first signal transmitting ground unit for transmitting to said first signal transmitting ground unit a first spot information signal when the corresponding block section signal is in the stop aspect and for transmitting to said first signal transmitting ground unit a cancellation signal when the corresponding block section signal is in the caution or go aspect; at least two further signal transmitting ground units positioned at intervals between each first signal transmitting ground unit and the corresponding block section signal; further signal transmitting means coupled between each block section signal and the corresponding further signal transmitting ground units for transmitting to said further signal transmitting ground units further successive spot information signals corresponding to the respective positions of said further signal transmitting ground units when the corresponding block section signal is in the stop aspect and for transmitting to said further signal transmitting ground units a cancellation signal when the corresponding block section signal is in the caution or go aspect; and a cancellation signal transmitting ground unit positioned adjacent each block section signal for transmitting a cancellation signal to said train unit and still further signal transmitting means coupled between each block section signal and the corresponding cancellation signal ground unit for transmitting to said cancellation signal ground unit a cancellation signal when the corresponding block section signal is in the caution or go aspect.

2. A spot control type automatic train stop system as claimed in claim 1 in which said first signal transmitting ground units are positioned subsequent to the block section signal, and all of the ground units for the corresponding block section signal are within the block section preceding said corresponding block section signal.

3. A spot control type automatic train stop system as claimed in claim 1 in which, for at least one particular block section signal, at least one of the ground units positioned in a block section which precedes said particular block section signal by at least one block section is in a position in said preceding block section common to the position of the first signal transmitting ground unit for said particular block section signal and has the signal transmitting means for the first signal transmitting ground unit of said particular block section signal connected thereto for transmitting to said commonly positioned ground unit a first spot information signal when said particular block section signal is in the stop aspect and said commonly positioned ground unit is not receiving a spot information signal from a block section signal preceding said particular block section signal, whereby the commonly positioned ground unit is a common ground unit for the block section in which it is located as well as for the particular block section signal.

4. A spot control type automatic train stop system as claimed in claim 3 in which said lastmentioned ground unit is a further ground unit.

5. A spot control type automatic train stop system as claimed in claim 3 in which said lastmentioned ground unit is a cancellation signal ground unit.

6. A spot control type automatic train stop system as claimed in claim 3 in which, for said particular block section signal, at least one of the ground units positioned in a block section which precedes said particular block section signal by at least one block section is in a position in said preceding block section common to the position of one of the further ground units for said particular block section signal and has the signal transmitting means for the further ground unit of said particular block section signal connected thereto for transmitting to said commonly positioned ground unit a further spot information signal when said particular block section signal is in the stop aspect and said commonly positioned ground unit is not receiving a spot information signal from a block section signal preceding said particular block section signal, whereby said commonly positioned ground unit is a common ground unit for the block section signal in which it is located as well as for the particular block section signal.

7. A spot control type automatic train stop system as claimed in claim 6 in which said lastmentioned ground unit is a further ground unit.

8. A spot control type automatic train stop system as claimed in claim 6 in which said lastmentioned ground unit is a cancellation signal ground unit.

* * * * *